US008185025B2

(12) United States Patent
Yamada et al.

(10) Patent No.: US 8,185,025 B2
(45) Date of Patent: May 22, 2012

(54) DEVICE FOR DEVELOPING AN ELECTROSTATIC LATENT IMAGE, AND PROCESS CARTRIDGE AND IMAGE FORMING APPARATUS INCLUDING THE SAME

(75) Inventors: Shintaro Yamada, Osaka (JP); Shin Murayama, Hyogo (JP); Ryuji Inoue, Hyogo (JP); Shuuichi Nakagawa, Osaka (JP); Kazushige Ohnishi, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 367 days.

(21) Appl. No.: 12/506,691

(22) Filed: Jul. 21, 2009

(65) Prior Publication Data

US 2010/0028057 A1 Feb. 4, 2010

(30) Foreign Application Priority Data

Jul. 31, 2008 (JP) ..... 2008-198727

(51) Int. Cl.
*G03G 15/08* (2006.01)

(52) U.S. Cl. ..... 399/284; 399/285

(58) Field of Classification Search ..... 399/284, 399/285

See application file for complete search history.

(56) References Cited

U.S. PATENT DOCUMENTS

| | | | | |
|---|---|---|---|---|
| 5,621,506 | A * | 4/1997 | Hosaka et al. | 399/284 |
| 5,870,658 | A * | 2/1999 | Goto et al. | 399/284 |
| 5,887,233 | A * | 3/1999 | Abe et al. | 399/284 |
| 6,038,416 | A | 3/2000 | Okano et al. | |
| 6,321,058 | B1 | 11/2001 | Miyasaka et al. | |
| 6,415,127 | B1 * | 7/2002 | Yamamoto et al. | 399/284 |
| 6,516,171 | B2 | 2/2003 | Miyasaka et al. | |
| 6,701,115 | B2 | 3/2004 | Miyasaka et al. | |
| 6,829,446 | B2 * | 12/2004 | Toizumi et al. | 399/53 |
| 6,895,211 | B2 | 5/2005 | Yamashita et al. | |
| 6,928,257 | B2 | 8/2005 | Ogiso et al. | |
| 7,209,681 | B2 | 4/2007 | Yamada et al. | |
| 7,227,562 | B2 | 6/2007 | Asuwa et al. | |
| 7,460,804 | B2 | 12/2008 | Onose et al. | |
| 2001/0028816 | A1 * | 10/2001 | Kakeshita et al. | 399/281 |
| 2006/0280529 | A1 | 12/2006 | Nakagawa et al. | |
| 2007/0189812 | A1 | 8/2007 | Murayama et al. | |
| 2008/0101823 | A1 | 5/2008 | Katoh et al. | |
| 2008/0131174 | A1 | 6/2008 | Inoue et al. | |
| 2008/0145109 | A1 | 6/2008 | Murayama et al. | |
| 2008/0175626 | A1 | 7/2008 | Murayama et al. | |
| 2008/0267641 | A1 | 10/2008 | Konishi et al. | |
| 2009/0041512 | A1 | 2/2009 | Murayama et al. | |

FOREIGN PATENT DOCUMENTS

| | | |
|---|---|---|
| JP | 8-202128 | 8/1996 |
| JP | 8-254894 | 10/1996 |

* cited by examiner

*Primary Examiner* — David Gray
*Assistant Examiner* — G. M. Hyder
(74) *Attorney, Agent, or Firm* — Oblon, Spivak, McClelland, Maier & Neustadt, L.L.P.

(57) ABSTRACT

A developing device develops an electrostatic latent image formed on an image carrier with toner. The developing device includes a developer carrier, a developer supplying unit that supplies a developer on the developer carrier, a layer shaping member that shapes the developer supplied on the developer carrier into a thin layer, and an electric-field control member that is arranged downstream of a shaping nip formed between the developer carrier and the layer shaping member and that controls an intensity of an electric field generated between the developer carrier and the layer shaping member.

11 Claims, 5 Drawing Sheets

DEVICE FOR DEVELOPING AN ELECTROSTATIC LATENT IMAGE, AND PROCESS CARTRIDGE AND IMAGE FORMING APPARATUS INCLUDING THE SAME

CROSS-REFERENCE TO RELATED APPLICATIONS

The present application claims priority to and incorporates by reference the entire contents of Japanese priority document 2008-198727 filed in Japan on Jul. 31, 2008.

BACKGROUND OF THE INVENTION

1. Field of the Invention

The present invention relates to a technology for developing a latent image formed on an image carrier with a single-component developer.

2. Description of the Related Art

A tandem-type image forming apparatus forms developer images in different colors on a photosensitive element in a plurality of process cartridges, transfers the developer images onto an intermediate transfer unit in a superimposed manner, and transfers the superimposed image onto a transfer sheet, thereby forming a color image.

Each of the process cartridge includes, as a unit, the photosensitive element on which a latent image is formed; a roller charging device that charges a surface of the photosensitive element; a developing unit that develops a latent image on the surface of a photosensitive element with powdery developer, thereby forming the developer image; and a cleaning device that cleans residual developers remained on the photosensitive element after the transfer.

The developing unit includes a developer carrier that is in contact with the photosensitive element and that supplies the developer onto the photosensitive element; a developer supplying member and a layer shaping member that are arranged in contact with the developer carrier; and a developer housing unit that stores therein the developer. The intermediate transfer unit is formed of a belt. The process cartridges for each color are arranged in parallel and facing the intermediate transfer belt.

The developing unit charges the developer, and conveys the charged developer by the developer carrier passing through the layer shaping member that is charged. When the developer passes through the layer shaping member, an amount of the conveyed developer is regulated, and the conveyed developer is further charged. However, if a polarity of the voltage applied to the layer shaping member and a polarity of charged developer are opposite, normally the charged developer that is to be conveyed by the developer carrier scatters and adheres to the layer shaping member.

In other words, when providing an electric potential difference between the developer carrier and the layer shaping member that shapes the developer on the developer carrier into a layer, the developer that is shaped into the layer on the developer carrier scatters and accumulates on the layer shaping member, depending on a polarity of the charged developer or a charging distribution. The developer accumulated on the layer shaping member falls due to a vibration and the like of the image forming apparatus, which causes image failures or image degradation.

When a polarity of the voltage applied to the layer shaping member and a polarity of the charged developer are the same, a tiny amount of developer that is charged to a polarity opposite to the developer that passed through the layer shaping member scatters (flies) to the layer shaping member.

A typical way to solve the above-described problems is to set the voltage to be applied low, by making the polarity of the voltage applied to the layer shaping member and the polarity of the charged developer identical.

However, when setting the applied voltage low, although the problem of the developer scattering to the layer shaping member can be prevented, it is impossible to apply a voltage strong enough to improve the charging performance of the developer, which is a primary purpose.

Japanese Patent Application Laid-open No. H8-254894 discloses a method of stabilizing charging performance of the developer and removing the developer adhering to the layer shaping member by arranging a rotating member, serving as the layer shaping member for the developer. A re-charging member for the developer is in press contact with the rotating layer shaping member; therefore, the developer adhered to the layer shaping member is charged. In this way, the developer returns to the developer carrier in an electrostatic state.

Japanese Patent Application Laid-open No. H8-202128 discloses a method of reducing the developer adhered on a base surface of an image carrier, while improving supply performance of the developer, by setting voltages applied to the layer shaping member, a developer supplying member, and a developer carrier and setting polarities thereof in conforming with a polarity of a charged developer.

With the method disclosed in Japanese Patent Application Laid-open No. H8-254894, a high voltage can be applied; however, the configuration is complicated because the layer shaping member is formed of the rotational member. This causes problems such as complicated installation and an increase of the number of types of the required materials and the number of the required components.

With the method disclosed in Japanese Patent Application Laid-open No. H8-202128, the voltages and the polarities in conforming with the polarity of the charged developer are set; however, sufficient voltages cannot be applied.

SUMMARY OF THE INVENTION

It is an object of the present invention to at least partially solve the problems in the conventional technology.

According to one aspect of the present invention, there is provided a developing device that develops an electrostatic latent image formed on an image carrier with toner. The developing device includes a developer carrier, a developer supplying unit that supplies a developer on the developer carrier, a layer shaping member that shapes the developer supplied on the developer carrier into a thin layer, and an electric-field control member that is arranged downstream of a shaping nip formed between the developer carrier and the layer shaping member and that controls an intensity of an electric field generated between the developer carrier and the layer shaping member.

Furthermore, according to another aspect of the present invention, there is provided a process cartridge including an image carrier on which an electrostatic latent image is formed and a developing device that develops the electrostatic latent image formed on the image carrier with toner. The developing device includes a developer carrier, a developer supplying unit that supplies a developer on the developer carrier, a layer shaping member that shapes the developer supplied on the developer carrier into a thin layer, and an electric-field control member that is arranged downstream of a shaping nip formed between the developer carrier and the layer shaping member and that controls an intensity of an electric field generated between the developer carrier and the layer shaping member. At least the image carrier and the developing device are provided in an integral manner.

Moreover, according to still another aspect of the present invention, there is provided an image forming apparatus including a developing device that develops an electrostatic latent image formed on an image carrier with toner. The developing device includes a developer carrier, a developer supplying unit that supplies a developer on the developer carrier, a layer shaping member that shapes the developer supplied on the developer carrier into a thin layer, and an electric-field control member that is arranged downstream of a shaping nip formed between the developer carrier and the layer shaping member and that controls an intensity of an electric field generated between the developer carrier and the layer shaping member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
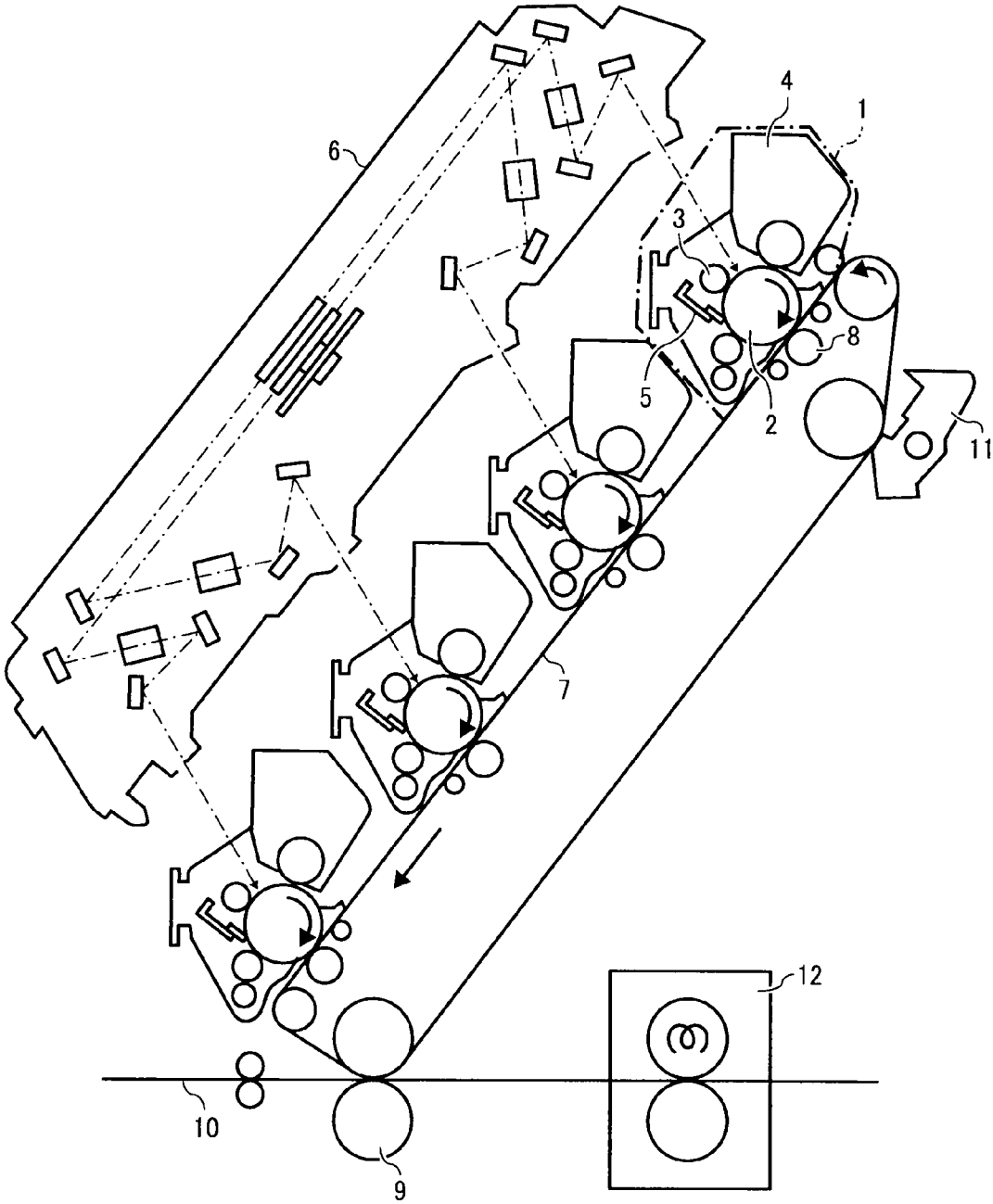
FIG. 1 is a schematic diagram of an image forming apparatus according to a first embodiment of the present invention.

Exemplary embodiments of the present invention are described in detail below with reference to the accompanying drawings.

The configuration of an image forming apparatus according to a first embodiment of the present invention is described with reference to FIG. 1.

The image forming apparatus includes a plurality of process cartridges 1 serving as image stations. Each of the process cartridges 1 includes a photosensitive element 2 serving as an image carrier, a charging member 3, a developing unit 4, and a photosensitive-element cleaning unit 5, which are arranged as a unit in each process cartridge 1. Each of the process cartridges 1 is attached to the main body in a detachable manner. The process cartridges 1 are detached from the main body by releasing stoppers (not shown) arranged at each of the process cartridge 1.

The photosensitive element 2 rotates in the direction indicated by an arrow in FIG. 1. The charging member 3 is in press contact with a surface of the photosensitive element 2 and rotates in association with the rotation of the photosensitive element 2.

A bias is applied to the charging member 3 by a high-voltage power supply (not shown), and therefore, the surface of the photosensitive element 2 is charged. In the first embodiment, a contact charging system is used, in which the photosensitive element 2 is charged by the roller shaped charging member 3 being arranged in a contact manner with the photosensitive element 2. However, a non-contact charging system can be used, in which the photosensitive element 2 is charged in a non-contact manner with the charging member 3.

An exposing unit 6 exposes the photosensitive element 2 based on image information, thereby forming a latent image on the surface of the photosensitive element 2. In the first embodiment, a laser-beam scanning system in which a laser diode is used for the exposing unit 6; however, the configuration is not limited thereto. For example, a light emitting diode (LED) array can be used.

The developing unit 4 forms a toner image by developing the latent image on the photosensitive element 2 with a single-component toner in a contact manner. A predetermined developing bias is applied to the developing unit 4 from the high-voltage power supply.

The photosensitive-element cleaning unit 5 cleans a residual toner remaining on the surface of the photosensitive element 2 after the toner image is transferred.

The four process cartridges 1, for each color, i.e., yellow, cyan, magenta, and black, are arranged in parallel in the moving direction of an intermediate transfer belt 7. The process cartridges 1 sequentially transfer the toner images onto the intermediate transfer belt 7, thereby forming a superimposed visible image.

A primary transfer bias is applied to a portion between a primary transfer roller 8 and the photosensitive element 2 by the high-voltage power supply, and then a developer image formed on the surface of the photosensitive element 2 is transferred onto a surface of the intermediate transfer belt 7. A driving motor (not shown) moves the intermediate transfer belt 7 in the direction indicated by an arrow in FIG. 1 in a rotatable manner. With a movement of the intermediate transfer belt 7, the visible images for each color are sequentially transferred in a superimposed manner. Thus, a full-color image is formed.

The full-color image is transferred onto a sheet 10, which is a transfer material, by applying a predetermined voltage to a portion between a pair of secondary transfer rollers 9 and the intermediate transfer belt 7. The developer image transferred onto the sheet 10 is fused by heat and a pressure in a fusing unit 12 and is discharged out of the unit.

The residual developer that is not transferred onto a surface of the secondary transfer rollers 9 and that remains on the intermediate transfer belt 7 is collected by a transfer-belt cleaning unit 11.

Figure 2:
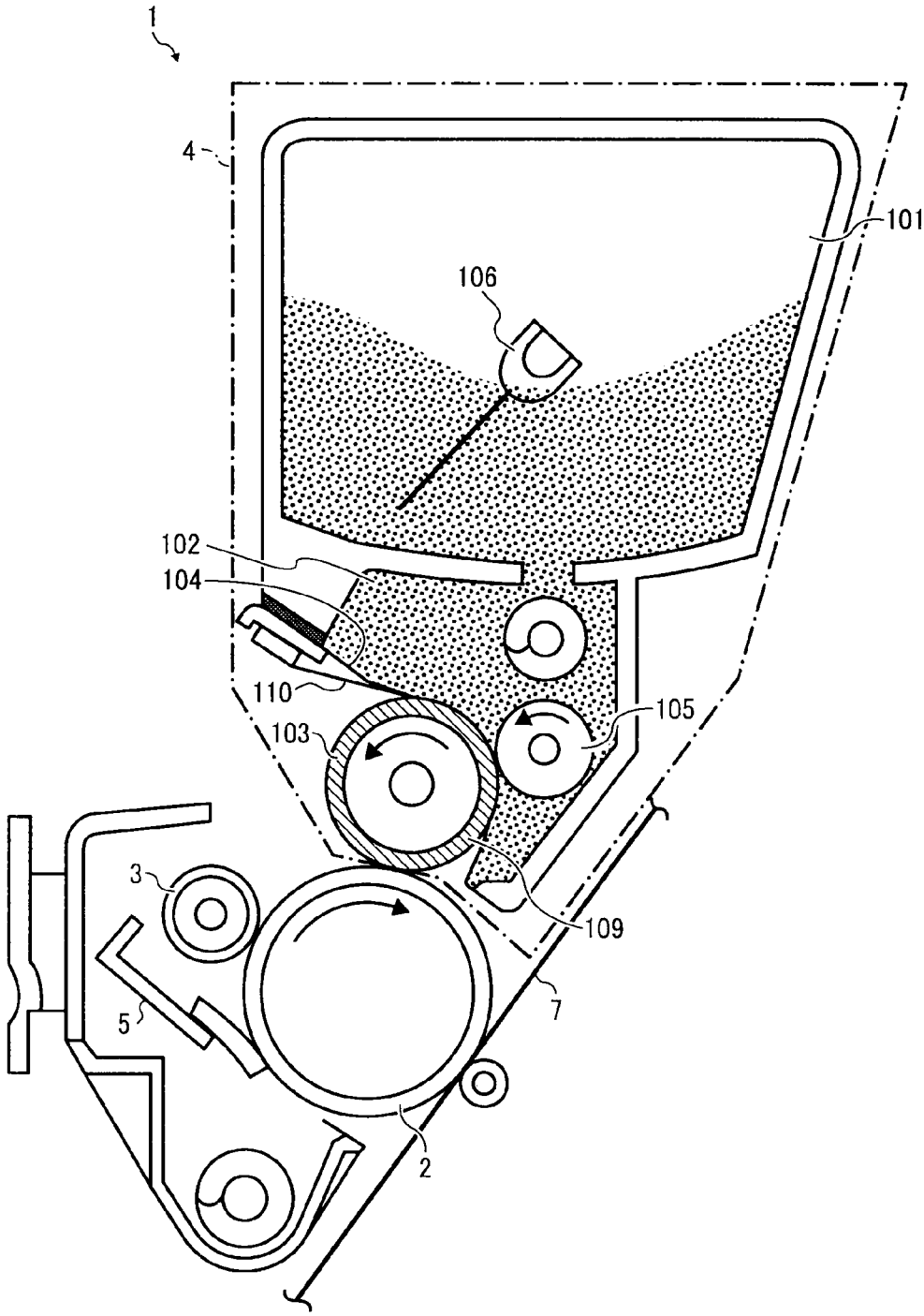
FIG. 2 is a magnified view of a process cartridge shown in FIG. 1.

FIG. 2 is a schematic diagram of the process cartridge 1. The developing unit 4 includes a developer housing unit 101 that stores therein a developer and a developer supplying unit 102 that is arranged below the developer housing unit 101.

A developing roller 103 serving as a developer carrier, a layer shaping member 104 that abuts against the developing roller 103, and a supplying roller 105 are arranged below the developer supplying unit 102.

The developing roller 103 is in contact with the photosensitive element 2. A predetermined developing bias is applied to the developing roller 103 from the high-voltage power supply. A developer stirring member 106 is arranged in the developer housing unit 101.

A foamed material having holes (cells) is coated on a surface of the supplying roller 105, which makes it possible to efficiently collect the developer conveyed into the developer supplying unit 102 by adhering the developer to the surface of the supplying roller 105. This also makes it possible to prevent the developer from being degraded caused by a pressure concentrated on an abutting portion between the developing roller 103 and the supplying roller 105. Electric resistance of the foamed material is set to from $10^3\Omega$ to $10^{14}\Omega$.

An offset voltage, which has the same polarity as that of the developer with respect to an electric potential of the developing roller 103, is applied to the supplying roller 105 as a supply bias. The supply bias acts in the direction in which a pre-charged developer is pressed against the developing roller 103 at the abutting portion.

However, the polarity of the voltage applied to the supplying roller 105 is not limited thereto. For example, the same electric potential as the developing roller 103 can be applied, or the polarity can be inverted, depending on the type of developer.

The supplying roller 105 rotates counterclockwise and spread the developer that is adhered on the supplying roller 105 onto a surface of the developing roller 103.

A roller covered with an elastic rubber layer is used for the developing roller 103. In addition, on top of the elastic rubber layer, a coating layer made of a material that tends to charge to the opposite polarity of the developer is arranged. Hardness of the elastic rubber layer is set to equal to or less than a JIS-A hardness of 50 degree to keep in contact with the photosensitive element 2 constant. Electric resistance of the elastic rubber layer is set to from $10^3\Omega$ to $10^{10}\Omega$ to exert the developing bias.

Surface roughness Ra is set to from 0.2 micrometer to 2.0 micrometers, thereby retaining the required amount of the developer on the surface of the developing roller 103.

The developing roller 103 rotates counterclockwise, thus conveying the developer adhering on the surface of the developing roller 103 to a position opposed to a contact position between the layer shaping member 104 and the photosensitive element 2.

A metal plate spring made of, for example, SUS304CSP, SUS301CSP, or phosphor bronze is used for the layer shaping member 104. The free end of the layer shaping member 104 is in contact with the surface of the developing roller 103 by a pressing force of from 10 N/m to 100 N/m. The layer shaping member 104 shapes the developer passing through the layer shaping member 104 into a thin layer by the pressing pressure and applies an electric charge by triboelectric charging.

An offset voltage, which has the same polarity as that of the developer with respect to the electric potential of the developing roller 103, is applied to the layer shaping member 104 as a regulating bias to induce triboelectric charging.

The photosensitive element 2 rotates clockwise. Accordingly, the surface of the developing roller 103 moves in the same direction as the travelling direction of the photosensitive element 2 at a position where the developing roller 103 faces the photosensitive element 2.

The developer that is shaped into the thin layer on the developing roller 103 is conveyed, by a rotation of the developing roller 103, to the position where the developing roller 103 faces the photosensitive element 2. The developer is moved onto the surface of the photosensitive element 2 according to the developing bias applied to the developing roller 103 and an electric field produced by the latent image on the photosensitive element 2. In this way, the latent image is developed.

At a portion where the remaining developer on the developing roller 103 that is not developed on the photosensitive element 2 returns to the developer supplying unit 102, a sealing member 109 is arranged in contact with the developing roller 103, thereby sealing the portion to prevent the developer from leaking out of the developing unit.

An electric-field control member 110 is arranged downstream in the rotation direction of the developing roller 103 of a shaping nip between the layer shaping member 104. The electric-field control member 110 is in physically non-contact with the developing roller 103. The electric-field control member 110 is not electrically connected to the layer shaping member 104.

A desired voltage is set to the electric-field control member 110 by a later-described power supply. Accordingly, the intensity of the electric field, i.e., the number of electric line of forces, between the developing roller 103 and the layer shaping member 104 can be controlled, which makes it possible to prevent the charged toner from scattering, by an electrostatic force, from the surface of the developing roller 103 on the layer shaping member 104.

Figure 3:
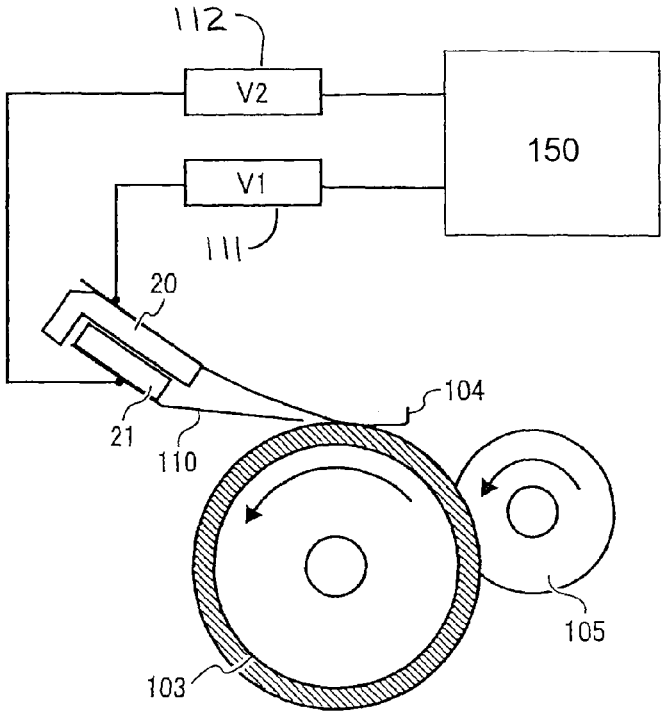
FIG. 3 is a schematic diagram of an electric-field control member and relevant parts near the electric-field control member.

A detailed description of the electric-field control member 110 is described with reference to FIG. 3. A base portion of the layer shaping member 104 is supported by a bracket 20, serving as a supporting member, that is secured to the main body of a developing unit (not shown). In a similar manner as in the layer shaping member 104, a base portion of the electric-field control member 110 is supported by a bracket 21, serving as a supporting member, that is secured to the main body of the developing unit, thereby a positional relation with respect to the layer shaping member 104 is determined. The bracket 20 is not electrically connected to the bracket 21.

A power supply 111 is connected to the electric-field control member 110. A power supply 112 is connected to the layer shaping member 104. Different voltages can be individually set to the power supplies 111 and 112. An electric-potential setting unit 150 may set an electric potential of the layer shaping member 104 and an electric potential of the electric-field control member 110. The toner supplied to the developing roller 103 via the supplying roller 105 is regulated its amount passing through the layer shaping member 104 and is charged due to a friction between the layer shaping member 104 and the developing roller 103.

The relation between the voltage V1 applied to the layer shaping member 104 and the voltage V2 applied to the electric-field control member 110 is $|V1|>|V2|$, regardless of the polarity of the toner mainly charged.

The magnitude of the voltage applied to the electric-field control member 110 is set smaller than that applied to the layer shaping member 104. This makes it possible to reduce the intensity of the electric field affecting the toner that passed through the shaping nip between the layer shaping member 104 and the developing roller 103, while maintaining the electric field generated in a region of the shaping nip, i.e., while maintaining an electric field strong enough to improve charging performance of the developer.

Specifically, the intensity of the electric field generated between the layer shaping member 104 and the developing roller 103 at the downstream side of the shaping nip is smaller than the intensity of the electric field generated at the downstream side of the shaping nip due to an electric potential difference applied to the shaping nip.

This prevents the electrostatic toner from adhering to the layer shaping member 104 due to scattering of the toner.

In the relation between the voltage V1 applied to the layer shaping member 104 and the voltage V2 applied to the electric-field control member 110, the polarities of the voltages to be applied can be the same, regardless of the polarity of the toner mainly charged (hereinafter, "polarity of the normally charged toner").

When the polarity of the electric potential in the shaping nip and the polarity of the charged developer are opposite, there is a possibility that a considerable amount of the normally charged developer in the shaping nip scatters on the layer shaping member 104 by the electrostatic force.

By making the polarities of the voltages applied to the layer shaping member 104 and the electric-field control member 110 same, when the polarity of the normally charged toner and the polarity of the voltage to be applied are the same, it is possible to prevent the electrostatic toner that passed the shaping nip from scattering, by an electrostatic force, on the layer shaping member 104.

When the polarity of the normally charged toner and the polarity of the voltage to be applied are opposite, it is possible to prevent the oppositely charged toner that is charged to the polarity opposite to that of the normally charged toner from scattering (hereinafter, "oppositely charged toner"), by an electrostatic force, on the layer shaping member 104. Accordingly, it is effective in a case where the ratio of the oppositely charged toner becomes high.

In the relation between the voltage V1 applied to the layer shaping member 104 and the voltage V2 applied to the electric-field control member 110, the polarities of the voltages to be applied can be opposite, regardless of the normally charged toner polarity.

By making the polarities of the voltages applied to the layer shaping member 104 and the electric-field control member 110 opposite, when the polarity of the normally charged toner and the voltage applied to the layer shaping member 104 are opposite, it is possible to prevent the electrostatic toner that passed the shaping nip from scattering, by an electrostatic force, on the layer shaping member 104.

When the polarity of the normally charged toner and the polarity of the voltage applied to the layer shaping member 104 are the same, it is possible to prevent the oppositely charged toner that is charged to a polarity opposite to that of the normally charged toner from scattering, by an electrostatic force, on the layer shaping member 104. Accordingly, it is effective in a case where the ratio of the oppositely charged toner becomes high.

The voltage V2 applied to the electric-field control member 110 can be variable according to environmental and temporal changes in a charge characteristic of the toner.

With a single-component developing unit, a charge characteristic of the developer is typically changed. Specifically, the charge characteristic of the toner is typically deteriorated as the toner comes closer to its life.

In particular, when comparing the states of the developer at the early stage and the last stage of its life, the ratio of the polarity of the developer that is normally charged to that of the oppositely charged becomes high. Accordingly, when the voltage to be applied is constant, the oppositely charged developer scatters on the layer shaping member 104 by the electrostatic force.

Therefore, by controlling the voltage applied to the electric-field control member 110, it is possible to prevent the developer that is charged to the opposite polarity from scattering (flying), by the electrostatic force, throughout the entire life of the developer.

By making the magnitude of the voltage V2 applied to the electric-field control member 110 lower at the last stage of the toner life rather than at the early stage thereof, it is possible to prevent the electrostatic toner from scattering on the layer shaping member 104, according to an increase in a degraded toner that is oppositely charged based on information from a page counter (not shown).

Figure 4:
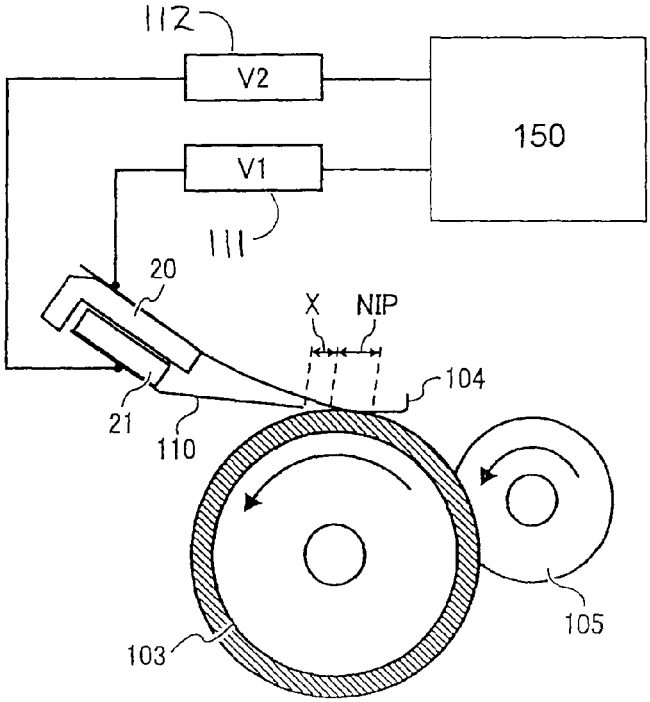
FIG. 4 is a schematic diagram of the electric-field control member shown in FIG. 3 for explaining a positional relation between a shaping nip and the electric-field control member.

FIG. 4 is a schematic diagram of the electric-field control member 110 illustrating the position of attaching the electric-field control member 110. To prevent the charged developer from scattering, downstream of the shaping nip, by the electrostatic force, on the layer shaping member 104 from the developing roller 103, the layer shaping member 104 needs to be covered as much as possible, downstream of the shaping nip, by the electric-field control member 110.

As a result of the experiment, the present inventors have found that, by arranging the electric-field control member 110 at a position within 5 millimeters, from the shaping nip between the developing roller 103 and the layer shaping member 104, the intensity of the electric field, i.e., the number of electric line of forces, from the developing roller 103 to the layer shaping member 104, can be decreased; therefore, the toner can be prevented from scattering on the layer shaping member 104.

Figure 5:
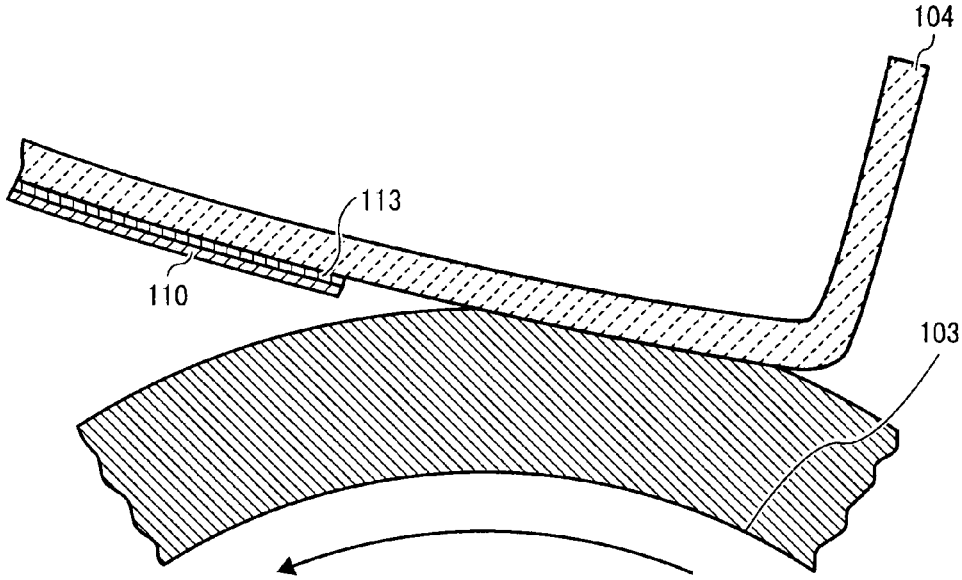
FIG. 5 is a schematic diagram for explaining the positional relation between an electric-field control member and a layer shaping member according to a second embodiment of the present invention.

FIG. 5 is a schematic diagram of the configuration of the electric-field control member 110 according to a second embodiment of the present invention. In the second embodiment, an insulator 113 is arranged on the layer shaping member 104. The insulator 113 is made of a material having resistance and resistance to pressure that do not cause short circuit when the voltages are applied to the layer shaping member 104 and the electric-field control member 110. The insulator 113 is formed between the conductive electric-field control member 110 and the layer shaping member 104. In this way, the electric-field control member 110 is integrated with the layer shaping member 104 via the insulator 113; therefore, the electric-field control member 110 can be arranged at the closest position to the shaping nip between the layer shaping member 104 and the developing roller 103.

By integrally forming the electric-field control member 110 with the layer shaping member 104, the number of types of the required materials and the number of the required components can be reduced, which makes it possible to simplify the attachment of the components to the developing unit 4.

Figure 6:
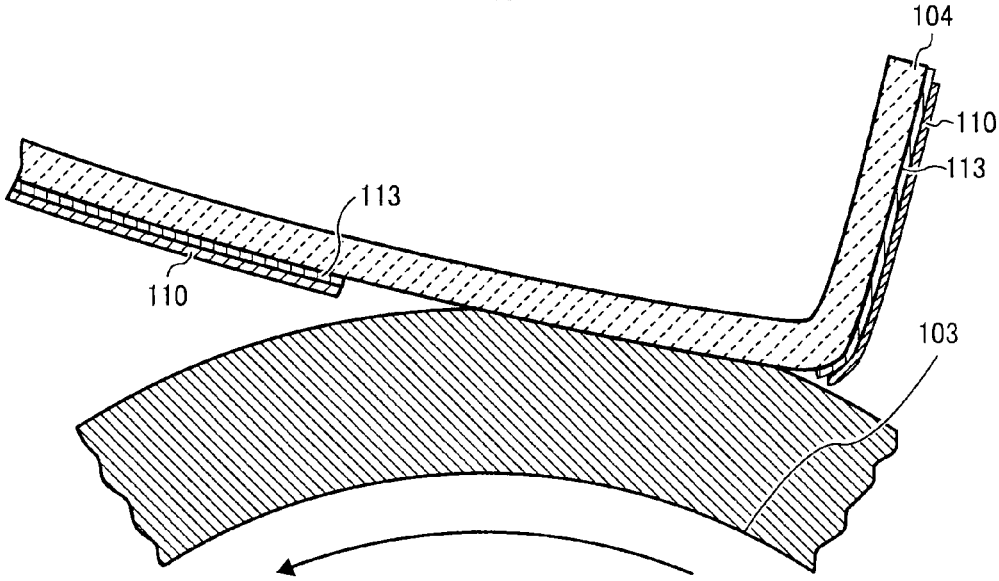
FIG. 6 is a schematic diagram for explaining the positional relation between an electric-field control member and a layer shaping member according to a third embodiment of the present invention.

FIG. 6 is a schematic diagram of the configuration of the electric-field control member 110 according to a third embodiment of the present invention. When the polarity of the charged developer and the polarity of the voltage applied to the layer shaping member 104 are opposite, the developer also adheres to upstream of the shaping nip at the layer shaping member 104 by the electrostatic force, thus preventing the supply of or stirring the developer. Accordingly, by forming the electric-field control member 110 upstream of the shaping nip between the layer shaping member 104 and the developing roller 103, it is possible to prevent the toner in the developer supplying unit 102 from adhering to the layer shaping member 104 by the electrostatic force.

As a result, circulation performance of the toner in the developer supplying unit 102 and supply performance of the toner to the developing roller 103 is improved.

Figure 7A:
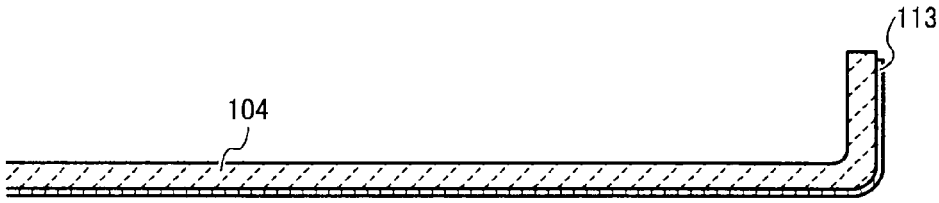
FIGS. 7A to 7C are cross-sectional views for explaining a process of forming the electric-field control member according to the third embodiment.
Figure 7B:
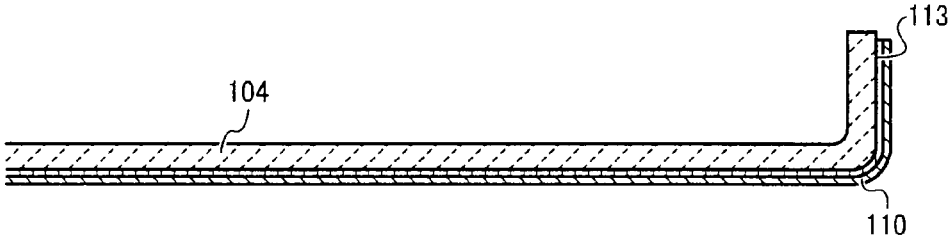
Figure 7C:
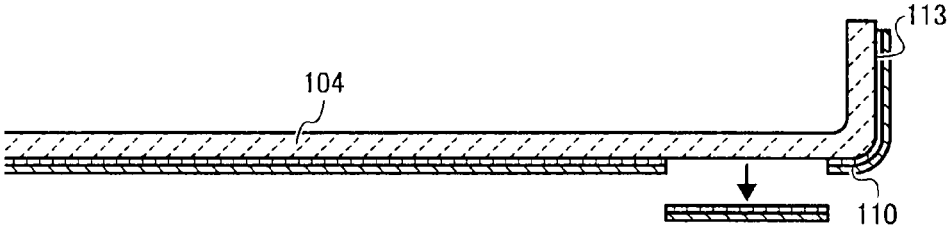

FIGS. 7A to 7C are cross-sectional views for explaining a process of forming the electric-field control member 110 according to the third embodiment. The layer shaping member 104, the insulator 113, and the electric-field control member 110 are formed in this order as layers by a coating processing or a vapor deposition processing. Accordingly, it is possible to simplify the manufacturing process and implement high productivity.

A substance having high resistance and high resistance to pressure, which serves as the insulator 113, is coated on a surface of the layer shaping member 104. In this case, any method can be used for coating, so long as pin holes are less likely to be made on a surface of the insulator after the coating processing or the vapor deposition processing. A conductive substance is then coated on the insulator 113, thereby forming the electric-field control member 110.

After forming the insulator 113 and the electric-field control member 110, in this order, on the surface of the layer shaping member 104, a portion that is to be in contact with the developing roller 103 is removed. This processing allows the two electric-field control member 110 to be simultaneously formed near both ends of the shaping nip between the developing roller 103 and the layer shaping member 104.

After forming the insulator 113 and the electric-field control member 110 on the layer shaping member 104, the portion of the layer shaping member 104 in contact with the shaping nip is removed. This makes it possible to form the electric-field control member 110 at the closest positions to the shaping nip, upstream and downstream of the shaping nip, thus more effectively preventing the developer from scattering.

According to one aspect of the present invention, charging performance of a developer is improved by applying a sufficient voltage to a shaping nip between a developer carrier and a layer shaping member. It is possible to prevent the developer from scattering on the layer shaping member and to avoid the complicated configuration, thus obtaining stable image quality.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A developing device that develops an electrostatic latent image formed on an image carrier with toner, the developing device comprising:

a developer carrier;

a developer supplying unit that supplies a developer on the developer carrier;

a layer shaping member that shapes the developer supplied on the developer carrier into a thin layer;

an electric-field control member that is arranged downstream of a shaping nip formed between the developer carrier and the layer shaping member and that controls an intensity of an electric field generated between the developer carrier and the layer shaping member; and an electric-potential setting unit that sets an electric potential of the layer shaping member and an electric potential of the electric-field control member.

2. The developing device according to claim 1, wherein an electric potential difference between the developer on the developer carrier and the layer shaping member is larger than an electric potential difference between the developer on the developer carrier and the electric-field control member.

3. The developing device according to claim 2, wherein the electric potential of the layer shaping member and the electric potential of the electric-field control member have the same polarity.

4. The developing device according to claim 2, wherein the electric potential of the layer shaping member and the electric potential of the electric-field control member have opposite polarity.

5. The developing device according to claim 1, wherein the electric-field control member is arranged within 5 millimeters from a downstream end of the shaping nip.

6. The developing device according to claim 1, wherein the layer shaping member and the electric-field control member are integrally formed via an insulating layer.

7. The developing device according to claim 1, wherein a voltage applied to the electric-field control member is variable.

8. The developing device according to claim 1, further comprising a second electric-field control member arranged upstream of the shaping nip.

9. The developing device according to claim 8, wherein the electric-field control member and the second electric-field control member are formed by forming layers of the insulating layer and the electric-field control member on a surface of the layer shaping member in order, and removing a portion of the layers of the insulating layer and the electric-field control member corresponding to the shaping nip from the surface of the layer shaping member.

10. A process cartridge comprising:

an image carrier on which an electrostatic latent image is formed; and a developing device that develops the electrostatic latent image formed on the image carrier with toner, the developing device including:

a developer carrier, a developer supplying unit that supplies a developer on the developer carrier, a layer shaping member that shapes the developer supplied on the developer carrier into a thin layer, an electric-field control member that is arranged downstream of a shaping nip formed between the developer carrier and the layer shaping member and that controls an intensity of an electric field generated between the developer carrier and the layer shaping member; and an electric-potential setting unit that sets an electric potential of the layer shaping member and an electric potential of the electric-field control member, wherein at least the image carrier and the developing device are provided in an integral manner.

11. An image forming apparatus comprising:

a developing device that develops an electrostatic latent image formed on an image carrier with toner, wherein the developing device includes:

a developer carrier, a developer supplying unit that supplies a developer on the developer carrier, a layer shaping member that shapes the developer supplied on the developer carrier into a thin layer, an electric-field control member that is arranged downstream of a shaping nip formed between the developer carrier and the layer shaping member and that controls an intensity of an electric field generated between the developer carrier and the layer shaping member, and an electric-potential setting unit that sets an electric potential of the layer shaping member and an electric potential of the electric-field control member.

* * * * *